US006871694B2

(12) United States Patent
Bordignon et al.

(10) Patent No.: US 6,871,694 B2
(45) Date of Patent: Mar. 29, 2005

(54) DEVICE FOR IN-LINE TREATMENT OF ROLLED METAL PRODUCTS

(75) Inventors: Giuseppe Bordignon, Bicinicco (IT); Daniele Andreatta, Borso del Grappa (IT)

(73) Assignee: Danieli & C. Officine Meccaniche S.p.A.

( * ) Notice: Subject to any disclaimer, the term of this patent is extended or adjusted under 35 U.S.C. 154(b) by 0 days.

(21) Appl. No.: 10/380,649

(22) PCT Filed: Sep. 10, 2001

(86) PCT No.: PCT/EP01/10420

§ 371 (c)(1),
(2), (4) Date: Jul. 21, 2003

(87) PCT Pub. No.: WO02/22282

PCT Pub. Date: Mar. 21, 2002

(65) Prior Publication Data

US 2004/0011436 A1 Jan. 22, 2004

(30) Foreign Application Priority Data

Sep. 15, 2000 (IT) ..... MI2000A2020

(51) Int. Cl.[7] ..... B22D 11/00

(52) U.S. Cl. ..... 164/477; 164/483; 164/452; 164/455; 72/203; 72/204; 148/522; 148/559; 266/111

(58) Field of Search ..... 164/477, 483, 164/452, 455; 72/203, 204; 148/522, 559; 266/111

(56) References Cited

U.S. PATENT DOCUMENTS

| | | | | |
|---|---|---|---|---|
| 4,068,516 A | | 1/1978 | Wonisch | |
| 4,073,618 A | * | 2/1978 | Doi et al. | 422/12 |
| 4,633,620 A | * | 1/1987 | Lorenzi et al. | 451/6 |
| 5,284,042 A | * | 2/1994 | Benedetti | 72/204 |
| 5,666,707 A | | 9/1997 | Cryderman et al. | |
| 5,725,696 A | * | 3/1998 | Maresch et al. | 148/601 |
| 6,336,980 B1 | * | 1/2002 | Benedetti | 148/654 |

FOREIGN PATENT DOCUMENTS

| | | |
|---|---|---|
| EP | 0419447 | 9/1990 |
| EP | 0862954 | 1/1998 |
| WO | WO 00/71270 | 11/2000 |

* cited by examiner

*Primary Examiner*—Kiley S. Stoner
*Assistant Examiner*—I.-H. Lin
(74) *Attorney, Agent, or Firm*—Sampson & Associates, P.C.

(57) ABSTRACT

A device for treating rolled metal products obtained by continuous casting, such as bars, plates, structural shapes or the like, arranged in line with a rolling system, and comprising a cooling plate (9), an in-line cooling box (13), in-line pickling means (14), in-line quality control means (16) consisting of ultrasonic instruments or induced current instruments, a bundling and/or lashing area (15).

23 Claims, 4 Drawing Sheets

DEVICE FOR IN-LINE TREATMENT OF ROLLED METAL PRODUCTS

This application claims priority to International Patent Application Serial No. PCT/EP01/10420 filed on Sep. 10, 2001, claiming priority to Italian Patent Application Ser. No. M12000A002020 filed on Sep. 15, 2000.

1. Field of the Invention

The present invention relates to a device for in-line treatment of elongated rolled metal products, such as bars, plates, structural shapes or the like, and to the corresponding in-line treatment method. Such device is arranged in line with the rolling train and possibly with a system for in-line heat treatment of said rolled products.

2. State of the Art

Rolled products, typically bars with a round, square or shaped section, resulting from a rolling train, are generally cooled at temperatures near room temperature by means of a cooling plate. The rolled product is then picked up and conveyed to an area equipped with various machines performing cleaning or surface finishing operations of said product. Bars are generally divided into single elements before being introduced into said machines, and at the end of the cleaning cycle, carried out with said product still, they are taken out, possibly cut to dimension and conveyed to the inspection and control area in order to test their surface and inner quality. After that they can reach the bundling, lashing and storing area. The cleaning process usually takes place in batches, so as to accelerate production. Generally, devices such as blasting machines or the like are used to clean rolled products, for instance to remove surface scales. Said blasting machines consist of a system throwing blasting powders at extremely high speeds onto the still bars, which have previously been introduced in batches, thus achieving a mechanical pickling action.

A further kind of finishing system of the state of the art provides that rolled products are cooled directly on the cooling plate. Systems for straightening said bars and for cutting them to dimensions are then arranged in line. After the final cutting said bars are sent to the bundling, lashing and storing area.

In order to reduce the temperature of the casted product to a value near room temperature and to carry out the surface cleaning and quality control operations out of the line, the prior art mainly provides for two solutions.

The first solution consists in employing very long cooling plates. This solution has the disadvantage that it increases investment and management costs for said plates, highly increasing their overall dimensions.

The second solution consists in employing forced cooling systems, such as fans, spraying systems and the like, introduced directly into the plate. This solution shows the disadvantage that it increases manufacturing costs for the cooling systems, requiring larger areas and causing a high production of steam and sprayed water which affect all the machines of said system. If cooling fans used, the plant would also be more noisy.

The above-mentioned prior art solutions therefore show a low efficiency, a low capacity to control product temperature and high investments costs, not allowing to carry out in-line surface cleaning and quality control operations for the rolled product.

SUMMARY OF THE INVENTION

A main aim of the present invention is to overcome the aforesaid disadvantages by carrying out a device for in-line treatment which does not show the above-mentioned disadvantages.

A further aim of the present invention is to carry out a device of the above-mentioned type which performs in-line cooling and surface cleaning for the rolled product, allowing to use cheaper finishing devices with a reduction of their ageing. An additional aim of the present invention is to provide for a device of the above-mentioned type which achieves such a temperature and a surface finish of the rolled product to allow in-line surface and inner controls with common, and therefore cheaper, instruments.

These and other aims which will be evident in the light of the following description are achieved by means of a device for treating rolled metal products having an elongated shape, such as bars, plates, structural shapes or the like, arranged in line with and downstream from a rolling system, said treatment means comprising a cooling plate, characterized in that said treatment means include pickling means arranged in line downstream from said plate and upstream from a lashing and/or bundling area of said metal product.

In a preferred embodiment of the present invention said device is characterized in that it provides a cooling box arranged in line between said plate and said pickling means.

In a further advantageous embodiment of the present invention the above-mentioned device is characterized in that it provides of quality control means of said metal products arranged in an area placed between said pickling means and said bundling and/or lashing area. Other preferred embodiments of the device for in-line treatment are described more in detail in the dependent claims.

Thanks to these features the device for treating bars, plates, structural shapes and so on, allows to cool these products, coming from a rolling train or an area where in-line heat treatments are carried out, up to a temperature of 200–400° C. by means of a cooling plate. When these rolled products come out of said cooling plate, they are conveyed to the cooling box to be further cooled in a controlled way to the temperature at which finishing operations give optimum results.

Said temperature is advantageously lower than 100° C. Indeed, too high a temperature, higher than 100° C., could cause a reduction of the mechanical resistance of the rolled product, thus increasing its surface roughness due to the action of the blasting agent at high temperatures. An increase of roughness, however, cannot be tolerated for the following two main reasons.

First of all, it makes the correct performance of surface quality control operations more difficult. Ultrasonic systems for the detection of inner defects and induced current systems for the detection of surface defects are preferably used for said operations.

The performance of quality controls also requires product temperatures lower than 100° C., since above said temperature the accuracy of the results is reduced, with the danger of a greater wear of said instruments, or, which is even worse, their damaging.

The second reason is that a poor surface quality cannot be accepted for certain kind of products, and therefore it would be necessary to carry out additional finishing operations which would raise production costs.

By means of the aforesaid arrangement of the various parts of the treatment device it is possible to carry out an accurate control of the product temperature thanks to the in-line use of the cooling box, in view of the successive operations, also carried out in line, i.e. surface cleaning and finishing on the one hand, and surface and inner quality control on the other. Moreover, the surface cleaning can be carried out in view of the successive operations, also carried out in line, i.e. cutting to dimension, bundling and packaging said bars.

BRIEF DESCRIPTION OF THE FIGURES

Further features and advantages of the present invention will become apparent thanks to the detailed description of a preferred embodiment of a device for treating rolled metal products, shown by way of a non limiting example by means of the enclosed drawings, in which.

DETAILED DESCRIPTION OF A PREFERRED EMBODIMENT OF THE INVENTION

Figure 1:
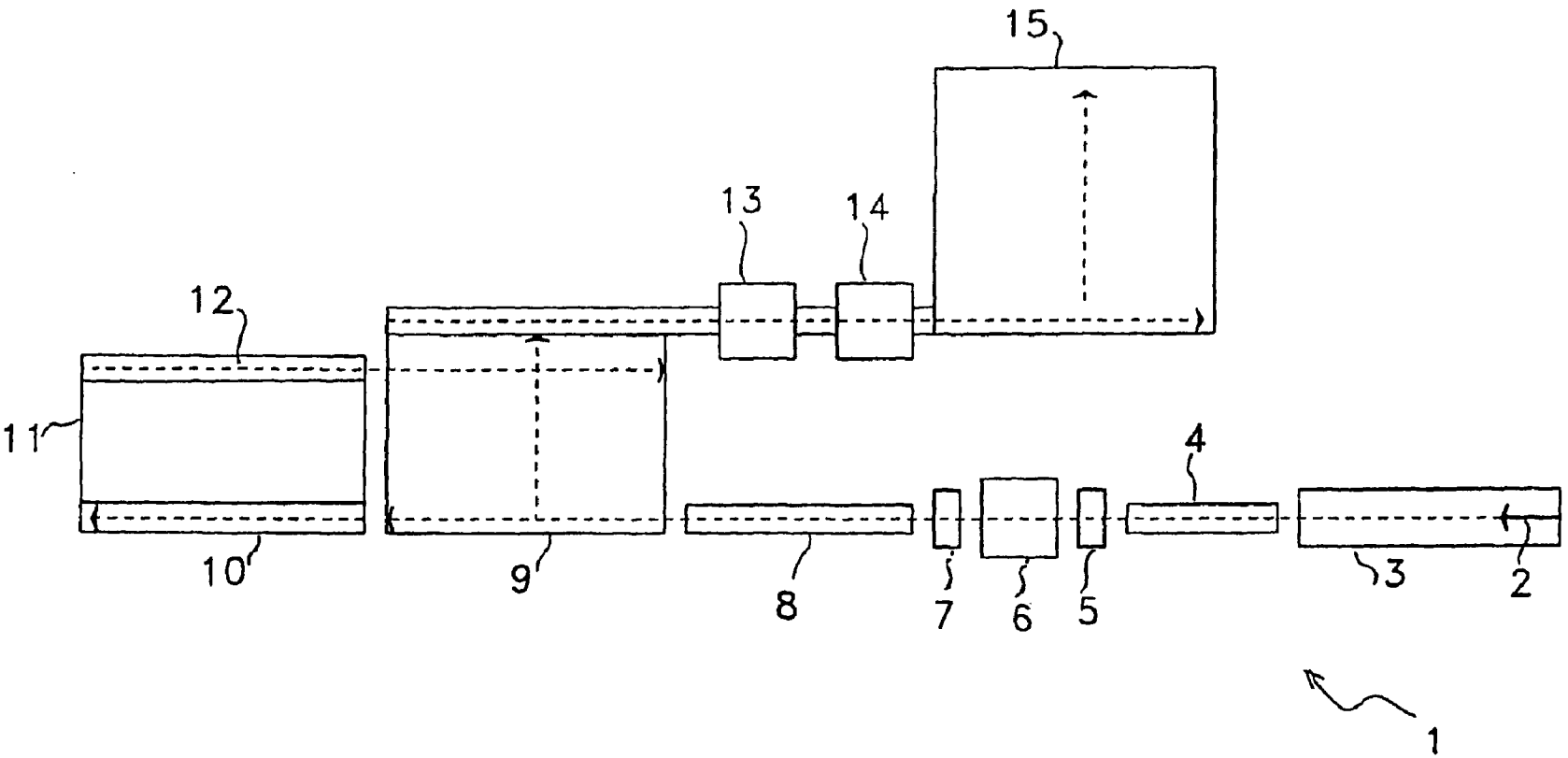
FIG. 1 is a schematic plan view of an in-line rolling/heat treatment device comprising the device for the final treatment of the rolled product according to the invention.

With reference to the above-mentioned FIG. 1, an in-line rolling/heat treatment system 1 manufactures the product, such as bars, plates, draw pieces and the like, which is worked and undergoes a heat treatment on the system line following the direction of the arrow 2. The product is worked in the rolling train 3, followed by a temperature control device 4, by a shearing machine 5, by a reduction and calibration block 6, by a shearing machine 7 and by a temper line 8, and proceeds to other heat treatment stages.

A cooling bed or plate 9 is placed downstream from the temper line 8. A bar discharge system 10 is placed at the outlet of the temper line 8, said system discharging the bars onto the cooling bed 9. Optionally, a tempering chamber 11 is placed downstream from the cooling bed 9, where said bars can pass in order to undergo a suitable additional annealing or tempering treatment when this is thought to be necessary to obtain a given kind of product. In such a case the discharge system introduces the bars into the cooling bed 9.

At the outlet of the cooling bed 9 said bars are introduced into a cooling box 13 and then into the blasting machine 14. Eventually, the bars are introduced into the area 15, where cutting, quality control, bundling and lashing operations occur.

The cooling box 13 and the blasting machine 14 can be placed near other devices for bar treatment according to the requirements and in view of the operations to be carried out onto the rolled products.

Figure 2:
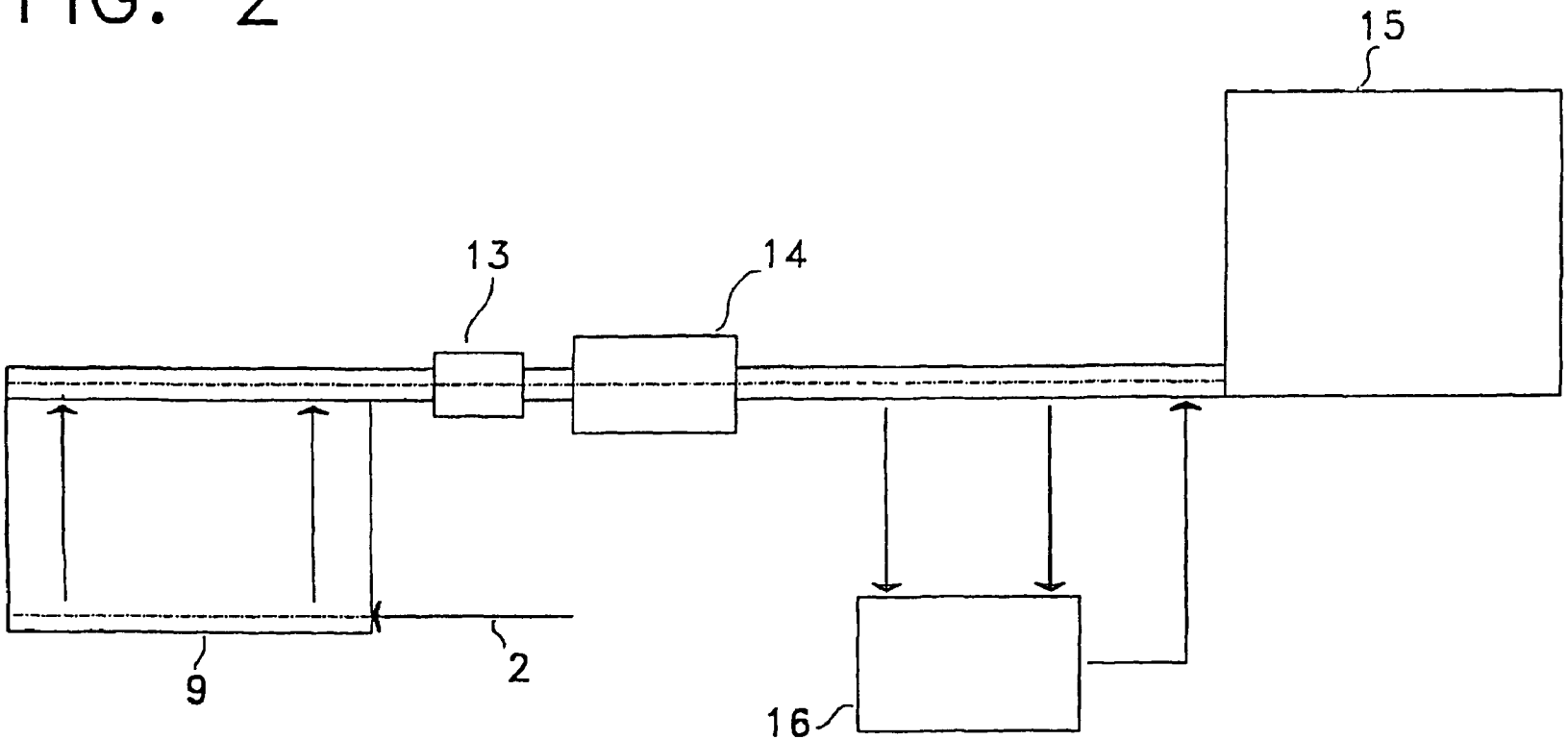
FIG. 2 is an enlarged plan view of an embodiment of the device for in-line treatment according to the invention.

In the main embodiment shown in FIG. 2, an area for product quality control 16 is arranged in line downstream from the blasting machine 14, said products passing through said area after undergoing a possible cutting-to-dimension and cutting-off operation made with suitable known means, not shown in the figure. After the quality control the products are conveyed to the packaging area 15.

Figure 3:
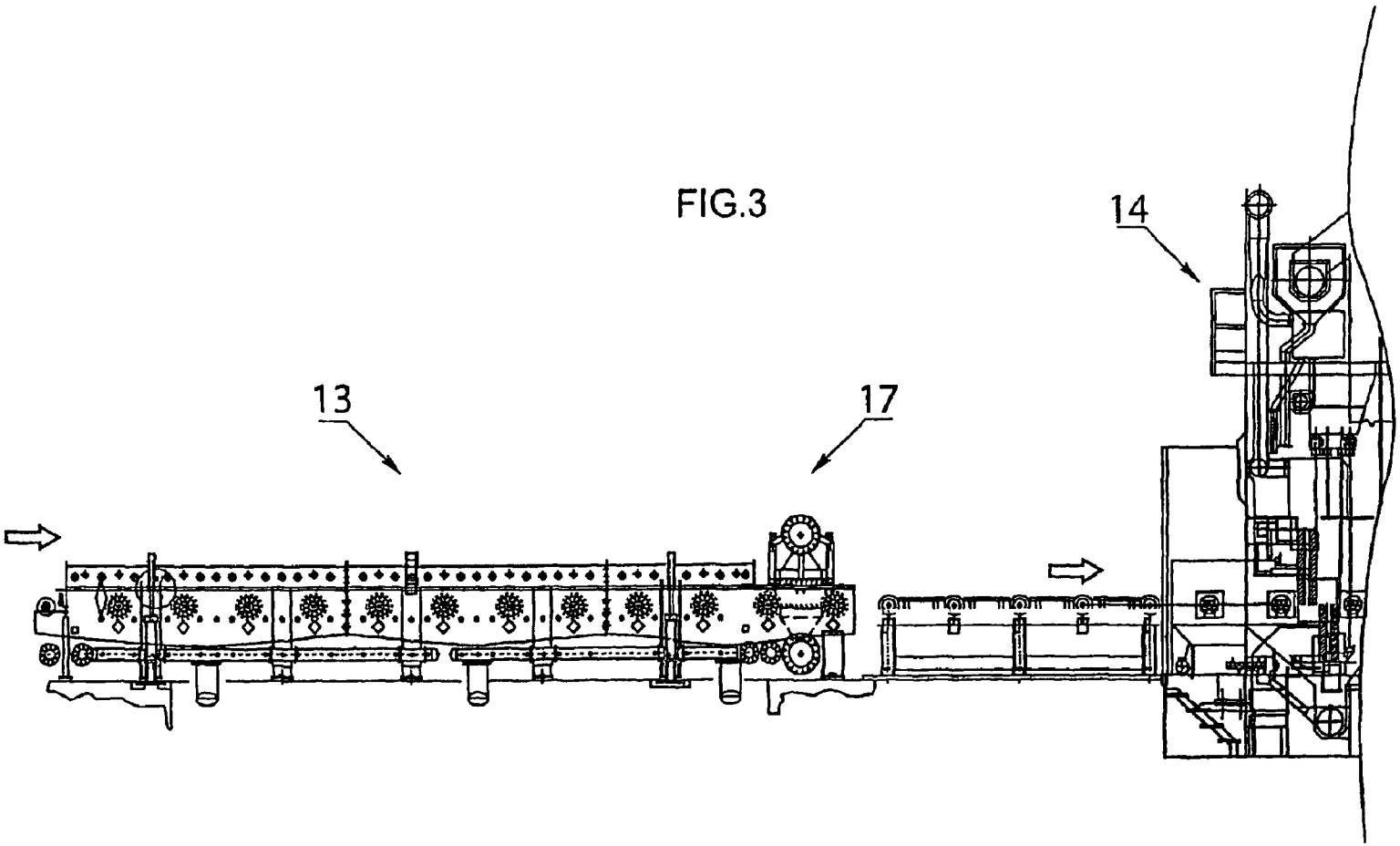
FIG. 3 is a longitudinal side view of a portion of the device of FIG. 2.

FIG. 3 shows a side view of the structure of the cooling box 13 and of the blasting machine 14, placed one after the other according to the embodiments in FIGS. 1 and 2.

The cooling box employed in the device according to the invention allows the simultaneous passage, according to the production requirements and to the casted product dimensions, of a suitable amount of bars. The bars in transit are struck by a series of water jets, or another cooling fluid, depending on their size, shape and transit speed. At the end of the water cooling area a drying area is arranged, said area operating with air streams 17.

The water flow is adjusted so that the bars at the outlet of the cooling box have a temperature lower than 100° C., so that the blasting operation can be carried out directly in line. The use of the cooling box allows to carry out an additional effective and targeted cooling stage of the rolled products, thus avoiding the above-mentioned drawbacks resulting from the use of the cooling plate only.

For instance, it has been observed that in the case of a rolled product with a nominal diameter of about 50 mm and a feed speed of 0.4 m/sec, in order to reduce its temperature from 400° C., taken up at the outlet of the cooling plate, to temperatures lower than 100° C., which it takes up at the inlet the blasting machine, a water delivery of about 25 $m^3/h$ for each passing bar is used. The openings of the blasting machine 14 for the outlet of the blasting powder are arranged transversally with respect to the bar axis so as to increase the effect of the surface cleaning action.

Figure 4:
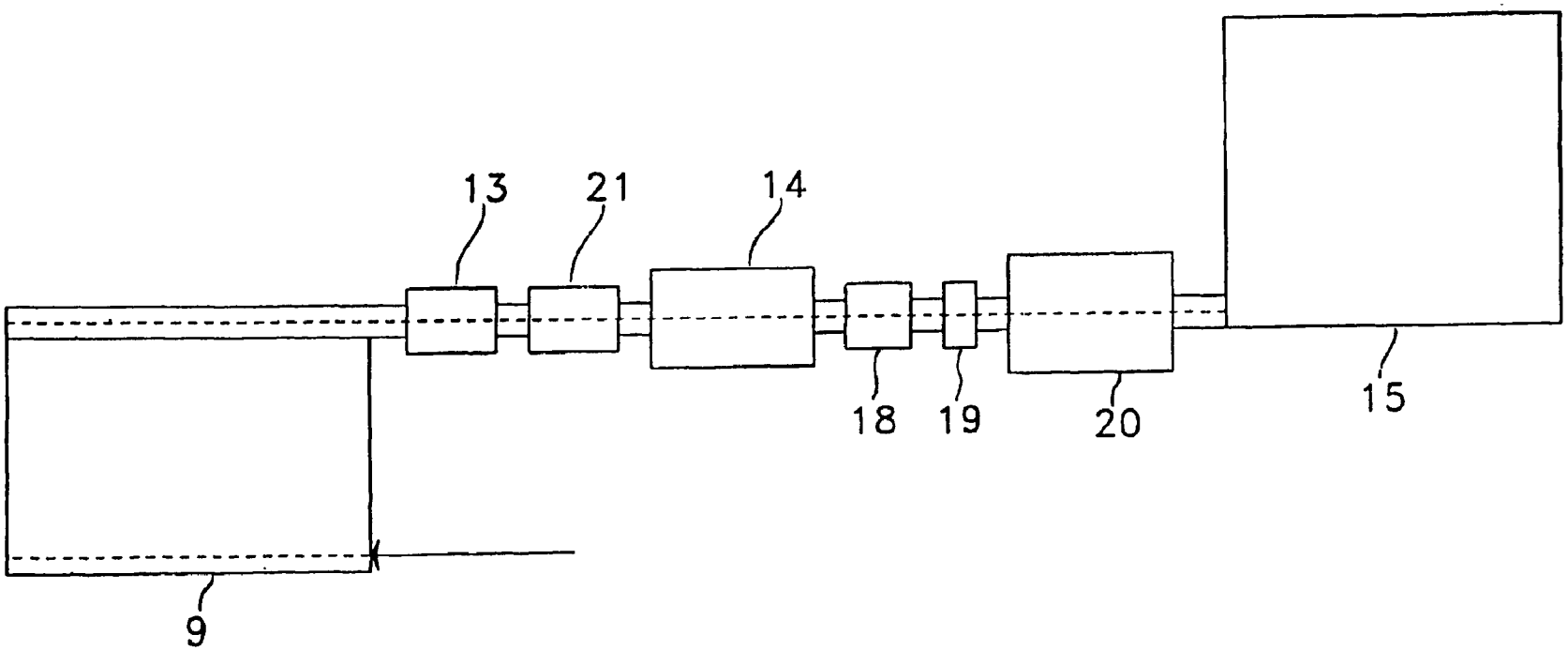
FIG. 4 is a schematic plan view of another variant of the treatment device of FIG. 2.

The embodiment of FIG. 4 differs from the one which has been previously described in FIGS. 1 and 2 in that quality controlled is not performed in line and in that a bar straightening section 21 is provided downstream from the cooling plate 9 and from the cooling box 13. Said section is followed by the blasting machine 14 and by a shearing machine 18 for cutting to dimension the products, which for instance reduce the length of the bar portions from 72 m to segments of commercial length varying from 6 to 12 m, and by a possible cutting-off machine 19 for the finish cut of the bar ends, and by the bundling and packaging section 15.

If necessary, in order to complete the treatment of the metal products another section 20 is provided, between the shearing machine 18 for cutting to dimension the bars or the cutting-off machine 19 and the bundling or packaging section 15, in which the treatment with anti-corrosive means, varnishes or drying means occurs. In another variant according to the invention the blasting machine 14 is replaced by a product surface de-scaling system using a high pressure water jet or chemical pickling.

In the aforesaid device according to the invention the rolled products, such as bars, plates, draw pieces or the like, undergo the treatment according to the following modes.

The casted metal products, manufactured with a continuously fed crystallizer, not shown, undergo a hot rolling in the rolling train 3. After further possible treatments, which are not an object of the present patent application, the bars are conveyed onto the cooling plate 9 and, for the additional cooling stage, go through the cooling box 13 and through successive pickling systems, possibly a blasting machine 14 or an equivalent pickling system.

Additional cutting-to-dimension, head- or tail-cutting-off stages of the metal products can be suitably provided after the pickling stage and before the bundling and/or lashing stage. Said operations are carried out by means of suitable shearing machines 18 and cutting-off machines 19.

After the cutting-to-dimension stage the quality control of the metal products is carried out by means of ultrasonic or induced current instruments.

The treatment can also include the additional straightening stage of the metal products, which is carried out after the cooling stage in said cooling box.

If necessary, the treatment of the rolled products also includes a treatment of said products with ant-corrosive agents, varnishes or drying means. Finally, the bundling and lashing stage of the products is carried out.

What is claimed is:

1. Device for treating casting metal products having an elongated shape, such as bars, plates, structural shapes or the like, arranged in line with and downstream from a rolling mill (3), said treatment means including in the following order a cooling bed (9), a cooling box (13), pickling means (14), in-line quality control means (16) of the cooled and pickled products and a bundling and/or lashing area (15) of the metal products, wherein the cooling box reduces the temperature of the metal products to a value lower than about 100° C.

2. Device according to claim 1, wherein said cooling box (13) is provided in its final portion with air streams (17) for drying and/or cooling said products.

3. Device according to claim 2, wherein said in-line cooling box (13) is adapted to convey one or more bars simultaneously.

4. Device according to claim 1, wherein the quality control means (16) consist of ultrasonic instruments or induced current instruments or the like.

5. Device according to claim 1, wherein there are provided straightening means (21) of said metal products arranged in line between said cooling box (13) and said pickling means (14).

6. Device according to claim 1, wherein there are provided cutting-to-dimension means (18) of said metal products arranged in line between said pickling means (14) and said bundling and/or lashing area (15).

7. Device according to claim 6, wherein there are provided for head and tail finish cutting means (19) of said metal products arranged in line between said pickling means (14) and said bundling and/or lashing area (15).

8. Device according to claim 1, wherein there are provided for treatment means (20) of said metal products with anti-corrosive agents and/or varnish and/or drying means arranged in line between said pickling means (14) and said bundling and/or lashing area (15).

9. Device according to claim 1, wherein said pickling means (14) consist of a blasting machine or the like.

10. Device according to claim 9, wherein said blasting machine (14) sends out jets of blasting particles around said products, said jets being placed on a plane which is substantially perpendicular to the advance direction of said products.

11. Device according to claim 1, wherein said pickling means (14) consist of chemical agents for pickling said casted products.

12. Device according to one or more of the claim 1, wherein said pickling means (14) consist of water jets for pickling said casted products.

13. Device according to claim 1, wherein said in-line pickling means (14) are adapted to treat one or more bars simultaneously.

14. Device according to claim 1, being disposed in line with a continuous casting system.

15. Method for treating casted metal products having an elongated shape, such as bars, plates, structural shapes or the like, by means of the device according to claim 1 comprising the following stages:

a) hot rolling of said metal products, b) cooling of said products by means of a cooling plate (9), c) additional in-line cooling in a cooling box (13), to reduce bar temperature to values lower than about 100° C.

(d) in-line pickling of said metal product through pickling means (14), e) in-line quality controlling of the metal products, f) bundling and/or lashing of said metal product in a suitable area (15).

16. Method according to claim 15, wherein the additional cooling stage in a cooling box (13) is divided into a cooling stage with water jets and a cooling/drying stage with air streams (17).

17. Method according to claim 16, wherein the in-line quality control stage is carried out with ultrasonic or induced current instruments.

18. Method according to claim 17, wherein there is provided the additional straightening stage of said metal products after the cooling stage in said cooling box (13) and before the pickling stage.

19. Method according to one claim 18, wherein there is provided the additional cutting-to-dimension stage of said metal products after the pickling stage and before the bundling and/or lashing stage.

20. Method according to claim 19, wherein there is provided the additional head- and tail-cleaning stage of said metal products after the cutting-to-dimension stage and before the control, bundling and/or lashing stages.

21. Method according to claim 20, wherein there is provided the additional treatment stage of said metal products with anti-corrosive agents or varnish or drying means after the pickling stage and before the bundling and/or lashing stage.

22. Method according to claim 21, wherein said in-line pickling stage is carried out onto one or more bars simultaneously, according to production requirements.

23. Method according to claim 22, wherein said in-line cooling stage is carried out onto one or more bars simultaneously, according to production requirements.

* * * * *